US009190191B2

(12) United States Patent
Kumada

(10) Patent No.: US 9,190,191 B2
(45) Date of Patent: Nov. 17, 2015

(54) EXTRA-FLEXIBLE INSULATED ELECTRIC WIRE

(71) Applicant: YAZAKI CORPORATION, Tokyo (JP)

(72) Inventor: Taketo Kumada, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 140 days.

(21) Appl. No.: 13/966,524

(22) Filed: Aug. 14, 2013

(65) Prior Publication Data

US 2013/0327557 A1 Dec. 12, 2013

Related U.S. Application Data

(63) Continuation of application No. PCT/JP2012/053887, filed on Feb. 17, 2012.

(30) Foreign Application Priority Data

Feb. 17, 2011 (JP) ..... 2011-031795

(51) Int. Cl.
*H01B 7/04* (2006.01)
*H01B 7/00* (2006.01)

(52) U.S. Cl.
CPC ..... *H01B 7/04* (2013.01); *H01B 7/0009* (2013.01)

(58) Field of Classification Search
None
See application file for complete search history.

(56) References Cited

U.S. PATENT DOCUMENTS

| | | | | |
|---|---|---|---|---|
| 2,604,509 | A * | 7/1952 | Blanchard | 174/108 |
| 4,471,161 | A * | 9/1984 | Drummond | 174/110 R |
| 6,103,976 | A | 8/2000 | Kobayashi et al. | |
| 2003/0037957 | A1 * | 2/2003 | Ueno et al. | 174/128.1 |

FOREIGN PATENT DOCUMENTS

| | | | |
|---|---|---|---|
| JP | 5-47237 | A | 2/1993 |
| JP | 7-57543 | A | 3/1995 |
| JP | 9-35541 | A | 2/1997 |
| JP | 2002-352630 | A | 12/2002 |
| JP | 2004-311208 | A | 11/2004 |
| JP | 2006-92933 | A | 4/2006 |

OTHER PUBLICATIONS

International Search Report and Written Opinion of the International Search Report for PCT/JP2012/053887 dated May 1, 2012.
Japanese Office Action for the related Japanese Patent Application No. 2011-031795 dated Jun. 30, 2015.

* cited by examiner

*Primary Examiner* — Timothy Thompson
*Assistant Examiner* — Guillermo Egoavil
(74) *Attorney, Agent, or Firm* — Kenealy Vaidya LLP

(57) ABSTRACT

An extra-flexible insulated electric wire includes a conductor portion and an insulating cover. The conductor portion includes an inner layer and an outermost layer. In the inner layer, conductive strands are collectively twisted. In the outermost layer, conductive strands are disposed along an outer circumference of the inner layer. The insulating cover covers the conductor portion.

2 Claims, 2 Drawing Sheets

EXTRA-FLEXIBLE INSULATED ELECTRIC WIRE

CROSS REFERENCE TO RELATED APPLICATIONS

This application is a continuation of PCT application No. PCT/JP2012/053887, which was filed on Feb. 17, 2012 based on Japanese Patent Application (No. 2011-031795) filed on Feb. 17, 2011, the contents of which are incorporated herein by reference.

BACKGROUND OF THE INVENTION

1. Field of the Invention

The present invention relates to an extra-flexible electric wire.

2. Description of the Related Art

In recent years, electric wires have been proposed which are used in movable portions like hands, arms, legs and the like of a humanoid robot (refer to JP-A-9-35541 and JP-A-5-47237). These electric wires are used in locations where complex motions take place, and therefore, high flexibility is required on those electric wires.

SUMMARY OF THE INVENTION

In the electric wires described in JP-A-9-35541 and JP-A-5-47237, however, when strands are twisted correctively, the following problem is caused. Namely, since a large number of strands exist in the collective twisting, strands in an outermost layer tends to easily enter an inner layer. When the strands in the outermost layer enter the inner layer, the flexibility of the electric wire may be deteriorated.

It is therefore one advantageous aspect of the present invention to provide an extra-flexible insulated electric wire having higher flexibility.

According to one advantage of the invention, there is provided an extra-flexible insulated electric wire comprising:

a conductor portion including an inner layer where conductive strands are collectively twisted and an outermost layer where conductive strands are disposed along an outer circumference of the inner layer; and an insulating cover which covers the conductor portion.

According to the extra-flexible insulated electric wire of the invention, since the strands are collectively twisted in the inner layer of the conductor portion, spaces are produced between the strands. This enables the strands to move so as to mitigate conductor strain when the electric wire is bent, whereby the flexibility of the electric wire is enhanced. In addition, since the strands are disposed along the outer circumference of the inner layer in the outermost layer, this follows that the outermost layer is twisted separately. This prevents the strands in the outermost layer from entering the inner layer. Consequently, it is possible to provide the extra-flexible insulated electric wire which has higher flexibility.

The extra-flexible insulated electric wire may be configured such that: a number N of the conductive strands disposed in the outermost layer is set by following equations, $$N \leq n-1$$

$$n = 360°/2\theta$$

$$\theta = \sin^{-1}[r/(d+r)],$$

the "n" is a natural number, the "r" is a radius of one of the conductive strands disposed in the outermost layer, and the "d" is a radius of the outer circumference of the inner layer.

According to the extra-flexible insulated electric wire, assuming that the radius of the single one of the strands disposed in the outermost layer is "r," the radius of the inner layer is "d," and the natural number resulting from dividing 360° by 2θ (θ is $\sin^{-1}(r/d+r)$) is "n," the number of strands disposed in the outermost layer is "N" which is equal to or less than n−1. Because of this, the number of strands in the outermost layer is reduced, thereby producing gaps between the strands in the outermost layer. By adopting this configuration, since the strands in the outermost layer move so as to mitigate conductor strain when the electric wire is bent, the flexibility is enhanced.

A radius of one of the conductive strands disposed in the outermost layer may be smaller than a radius of one of the conductive strands which are collectively twisted in the inner layer.

Since the radius of the single one of the strands disposed in the outermost layer is smaller than the radius of the single one of the strands which are collectively twisted together in the inner layer, a gap is produced between the strands in the outermost layer and the insulating cover. This enhances the flexibility of the electric wire.

According to the invention, it is possible to provide the extra-flexible insulated electric wire having higher flexibility.

DETAILED DESCRIPTION OF THE EXEMPLARY EMBODIMENTS

Figure 1:
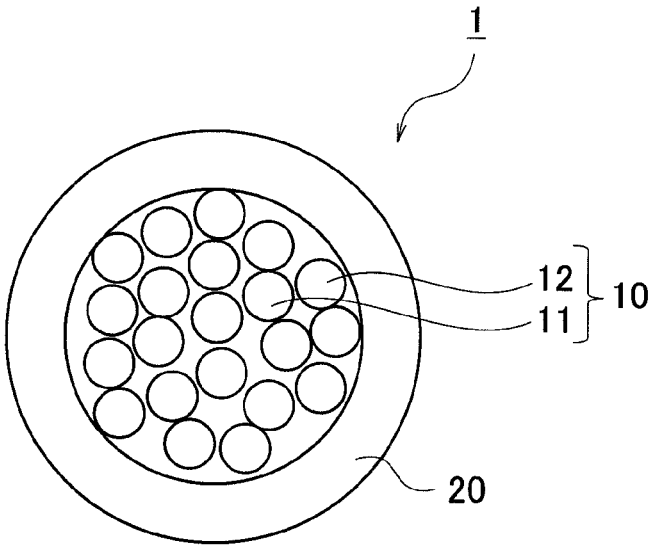
FIG. 1 is an exemplary view showing a section of an extra-flexible insulated electric wire according to the invention.
Figure 2:
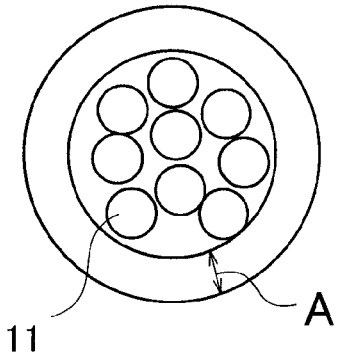
FIG. 2 is an exemplary view showing a section of an inner layer of a conductor portion.

Hereinafter, a preferred embodiment of the invention will be described based on the drawings. FIG. 1 is an exemplary view showing a section of an extra-flexible insulated electric wire according to the embodiment of the invention, and FIG. 2 is an exemplary view showing a section of an inner layer of a conductor portion. The extra-flexible insulated electric wire 1 shown in FIG. 1 includes a conductor portion 10 formed by twisting conductive strands 11, 12 and an insulating cover 20 which is applied on to the conductor portion 10.

In addition, as shown in FIGS. 1 and 2, the conductor portion 10 is formed by twisting pluralities of strands 11, 12 which are formed of a conductive member such as a copper alloy wire, for example. Additionally, the conductor portion 10 is made up of an inner layer and an outermost layer, and the inner layer is formed by collectively twisting the plurality of strands 11. The outermost layer is formed by disposing the strands 12 into a circumferential shape along an outer circumference of the inner layer. Reference character A in FIG. 2 denotes an area where the strands 12 of the inner layer are disposed. In this way, in the conductor portion 10 of this embodiment, the way of twisting the strands in the inner layer differs from the way of twisting the strands in the outermost layer, this enhancing the flexibility of the electric wire.

Namely, in the conductor portion 10, since the strands 11 are collectively twisted in the inner layer, spaces are produced between the strands 11. This enables the strands 11 to move so as to mitigate conductor strain when the electric wire is bent, whereby the flexibility is enhanced. Additionally, the strands 12 are disposed circumferentially along the outer circumference of the inner layer in the outermost layer. This allows the strands in outermost layer to be twisted separately from those in the inner layer, this preventing the strands 12 in the outermost layer from entering the inner layer.

Figure 3:
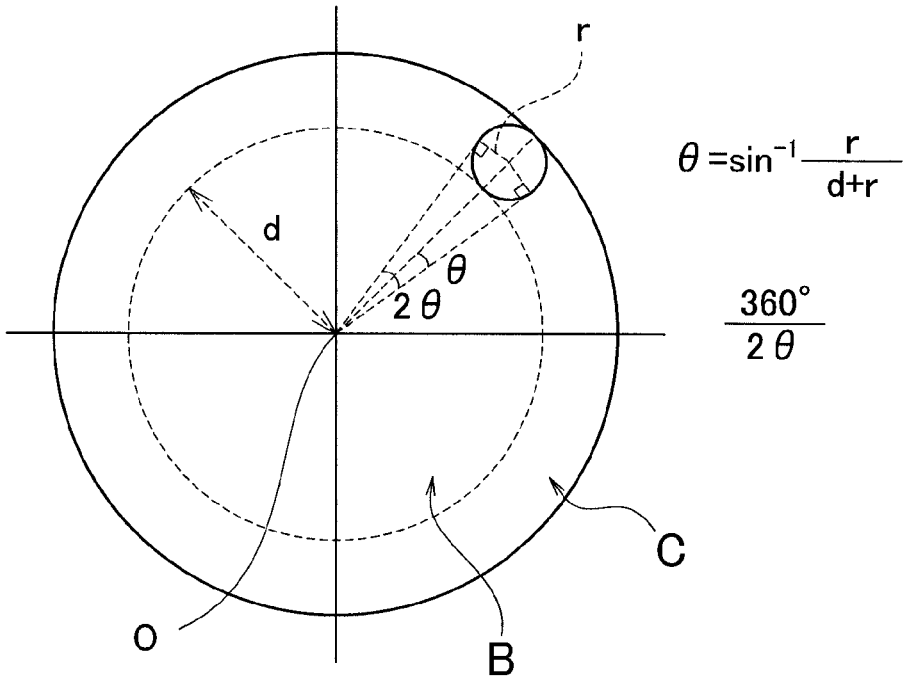
FIG. 3 is an explanatory view illustrating how to determine the number of strands in an outermost layer shown in FIG. 1.

In addition, the number of strands 12 in the outermost layer is determined as follows. FIG. 3 is an explanatory view illustrating how to determine the number of strands 12 in the outermost layer shown in FIG. 1. In FIG. 3, let's assume that a radius of a single one of the strands 12 disposed in the outermost layer is "r," and a radius of the outer circumference of the inner layer is "d." In this case, tangent lines extending from a center O of the extra-flexible insulated electric wire 1 to the outermost layer each form an angle θ with a line which connects the center O with a center of the strand 12, and these tangent lines constitute lines which extend within a angular range of 2θ from the center O. Because of this, assuming that a natural number resulting from dividing 360° by 2θ is "n," "n" strands 12 are just accommodated in the outermost layer.

Here, in this embodiment, the number of strands 12 used in the outermost layer is "N" calculated by n−1. By doing so, the number of strands 12 in the outermost layer is reduced, whereby gaps can be produced between the strands 12 in the outermost layer. Thus, this enables the strands in the outermost layer to move so as to mitigate conductor strain when the electric wire is bent, thereby making it possible to enhance the flexibility.

In this embodiment, while the number of strands 12 used in the outermost layer is n−1, the number of strands 12 is such as to form gaps between the strands 12 in the outermost layer, and hence, the number of strands 12 should be n−1 or less.

Further, in the embodiment, the radius of the single one of the strands 12 disposed in the outermost layer is smaller than the radius of the single one of the strands 11 collectively twisted together in the inner layer. Here, when a bore diameter of the insulating cover 20 is fixed, a gap is produced between the strands 12 in the outermost layer and an inner side of the insulating cover 20. This enables the strands 12 in the outermost layer to move so as to mitigate conductor strain when the electric wire is bent, whereby the flexibility is enhanced.

Table 1 is a table representing a comparison made between the extra-flexible insulated electric wire 1 according to this embodiment and a conventional extra-flexible insulated electric wire. In the extra-flexible insulated electric wire 1 according to this embodiment, the material of the conductor portion 10 is a copper alloy, a conductor configuration is 0.08/19 (mm/number of strands), and an average conductor outside diameter is 0.454 mm. In addition, the insulating cover 20 is formed from a PVC (polyvinyl chloride) material, and an average thickness thereof is 0.206 mm. An average finished outside diameter is 0.86 mm. In addition, an average weight of the extra-flexible insulated electric wire 1 is 1.5 g/m.

TABLE 1

| Product Identification | | | — | Embodiment of Invention | Conventional Product |
|---|---|---|---|---|---|
| Conductor Configuration | | | mm/number | 0.08/19 | 0.08/30 |
| Conductor | Material | — | | Copper alloy | Copper alloy |
| | Configuration | — | mm/number | 0.08/19 | 0.08/30 |
| | Outside diameter | Ave. | mm | 0.454 | 0.559 |
| Insulator | Material | | — | PVC | ETFE |
| | Ave. thickness | Ave. | mm | 0.206 | 0.18 |
| | Finished outside diameter | Ave. | mm | 0.86 | 0.92 |
| Electric wire | Weight | Ave. | g/m | 1.5 | 2.2 |
| 180-degree Bending test | ϕ = 25 mm | Ave. | number of times | 147.028 | 138.970 |

On the other hand, in the conventional extra-flexible insulated electric wire, the material of a conductor portion is a copper alloy, a conductor configuration is 0.08/30 (mm/number of strands), and an average conductor outside diameter is 0.559 mm. In addition, an insulating cover is formed from a ETFE (Ethylene Tetrafluoroethylene Copolymer) material, and an average thickness thereof is 0.18 mm. An average finished outside diameter is 0.92 mm. In addition, an average weight of the extra-flexible insulated electric wire is 2.2 g/m.

180-degree bending tests were carried out on the extra-flexible insulated electric wire 1 according to the embodiment and the conventional extra-flexible insulated electric wire. In the tests, a mandrel of ϕ25 was used, and a load of 400 gf was applied.

In the tests, in the extra-flexible insulated electric wire 1 according to this embodiment, a resistance value was raised 10% from an initial conductor resistance when the electric wire was bent 147028 times. On the other hand, in the conventional extra-flexible insulated electric wire, a resistance value was raised 10% from an initial resistance value when the electric wire was bent 138070 times. In this way, in the extra-flexible insulated electric wire 1 according to the embodiment, the conductor portion 10 is divided into the inner layer and the outermost layer, the strands 11 are collectively twisted in the inner layer, and the strands 12 are disposed circumferentially in the outermost layer, whereby conductor strain can be mitigated, thereby making it possible to enhance the flexibility.

Next, a fabrication method of the extra-flexible insulated electric wire 1 according to the embodiment will be described. Firstly, a predetermined number of strands 11 for use for the inner layer are prepared, and the strands 11 prepared are collectively twisted. Next, n−1 strands 12 for use for the outermost layer are prepared as described above. Then, the strands 12 prepared are disposed circumferentially along the outer circumference of the inner layer, whereby the conductor portion 10 is formed. As this occurs, it is desirable that the radius of the strand 12 is smaller than the radius of the strand 11.

Following this, an insulating cover 20 is extruded into a tubular shape, and the insulating cover 20 so formed is provided on the conductor portion 10, whereby the extra-flexible insulated electric wire 1 according to the embodiment is fabricated.

According to the extra-flexible insulated electric wire according to the embodiment which is fabricated in the way described above, in the conductor portion 10, the strands 11 are collectively twisted in the inner layer, and therefore, spaces are produced between the strands. This enables the strands 11 to move so as to mitigate conductor strain when the electric wire is bent, whereby the flexibility are enhanced. In addition, the strands 12 are disposed circumferentially along the outer circumference of the inner layer in the outermost layer. This enables the outermost layer to be twisted separately from the inner layer, and therefore, the strands 12 are prevented from entering the inner layer. Consequently, it is possible to provide the extra-flexible insulated electric wire 1 having higher flexibility.

In addition, assuming that the radius of the single one of the strands 12 disposed in the outermost layer is "r," the radius of the inner layer is "d," and the natural number resulting from dividing 360° by 2θ is "n," the "θ" is $\sin^{-1}[r/(d+r)]$, the number "N" of strands 12 disposed in the outermost layer is n−1. Because of this, the number of strands 12 in the outermost layer is reduced, thereby producing gaps between the strands 12 in the outermost layer. By adopting this configuration, since the strands 12 in the outermost layer move so as to mitigate the conductor strain when the electric wire is bent, the flexibility are enhanced.

Additionally, the radius of the single one of the strands 12 disposed in the outermost layer is smaller than the radius of the single one of the strands 11 in the inner layer. Due to this, the gap is produced between the strands 12 in the outermost layer and the insulating cover 20. This enables the strands 12 in the outermost layer to move so as to mitigate the conductor strain when the electric wire is bent, whereby the flexibility are enhanced.

In addition, as shown in Table 1, although the extra-flexible insulated electric wire according to the embodiment is made lighter in weight and thinner in diameter than those of conventional extra-flexible insulated electric wire, the flexibility can be enhanced.

Thus, while the invention has been described based on the embodiment, the invention is not limited to the embodiment described heretofore, and hence, the invention may be modified variously without departing from the spirit and scope of the invention.

For example, in the extra-flexible insulated electric wire according to the embodiment, while the strands 11, 12 are formed of the copper alloy, the invention is not limited to the alloy, and hence, other materials including a soft copper wire may be used. In the event that the strands 11, 12 are formed of a copper alloy (in particular, a copper alloy having a strength of 500 MPa or larger), when the extra-flexible insulated electric wire is connected to a connector, even though the extra-flexible insulated electric wire 1 is pulled, the extra-flexible insulated electric wire 1 is preferably made difficult to be dislocated from the connector.

While the invention has been described in detail and by reference to the specific embodiment, it is obvious to those skilled in the art to which the invention pertains that various alterations and modifications can be made without departing from the spirit and scope of the invention.

According to the invention, it is possible to provide the extra-flexible insulated electric wire having higher flexibility.

What is claimed is:

1. An extra-flexible insulated electric wire comprising:

a conductor portion including an inner layer where conductive strands are collectively twisted and an outermost layer where conductive strands are disposed along an outer circumference of the inner layer; and an insulating cover which covers the conductor portion, wherein a number N of the conductive strands disposed in the outermost layer is set by following equations, $$N \leq n-1$$

$$n = 360°/2\theta$$

$$\theta = \sin^{-1}[r/(d+r)]$$

the "n" is a natural number, the "r" is a radius of one of the conductive strands disposed in the outermost layer, and the "d" is a radius of the outer circumference of the inner layer.

2. The extra-flexible insulated electric wire according to claim 1, wherein a radius of each one of the conductive strands disposed in the outermost layer is smaller than a radius of one of the conductive strands which are collectively twisted in the inner layer.

* * * * *